US005431372A

United States Patent [19]

Kostelecky

[11] Patent Number: 5,431,372

[45] Date of Patent: Jul. 11, 1995

[54] SAFETY POST ASSEMBLY

[75] Inventor: Duane Kostelecky, Thornton, Colo.

[73] Assignee: Denpak Building Products, Inc., Denver, Colo.

[21] Appl. No.: 131,771

[22] Filed: Oct. 4, 1993

[51] Int. Cl.[6] ..... E04H 17/20

[52] U.S. Cl. ..... 256/64; 256/59; 256/DIG. 6; 182/45

[58] Field of Search ..... 256/24, 31, 35, 59, 256/63, 64, 65, 69, DIG. 6, 1; 182/45, 113; 248/500, 505, 507, 508; 160/135, 351

[56] References Cited

U.S. PATENT DOCUMENTS

| | | | |
|---|---|---|---|
| 2,960,335 | 11/1960 | Shuttleworth | 182/113 |
| 3,880,405 | 4/1975 | Brueske | 256/1 |
| 4,003,553 | 1/1977 | Morris | 256/59 |
| 4,015,827 | 4/1977 | Brand | 256/59 |
| 4,183,695 | 1/1980 | Wilcox | 256/1 |
| 4,311,300 | 1/1982 | Buerger | 256/1 |

*Primary Examiner*—Eric K. Nicholson
*Assistant Examiner*—Andrea Chop
*Attorney, Agent, or Firm*—John R. Flanagan

[57] ABSTRACT

A safety post assembly includes a flat mounting plate adapted to rest on a support surface, an upright post fixed in an upstanding relationship on a central portion of the mounting plate, a pair of elongated narrow anchoring straps having inner portions positioned over a pair of peripheral edge portions of the mounting plate and outer portions extending outwardly from the inner portions and the mounting plate so as to overlie portions of the support surface located adjacent to the mounting plate, and a plurality of fasteners adapted to attach the mounting plate and anchoring straps upon the support surface. The mounting plate has a plurality of holes defined therein along peripheral edge portions of the plate and in spaced relationship to one another. The anchoring straps also have pluralities of openings defined therein, some being in a spaced relationship to one another which matches the spaced relationship between the holes in the mounting plate. The fasteners are adapted to extend through openings in the anchoring straps and through holes in the mounting plate being aligned with the openings in the anchoring straps and then to be threadable into the support surface.

18 Claims, 2 Drawing Sheets

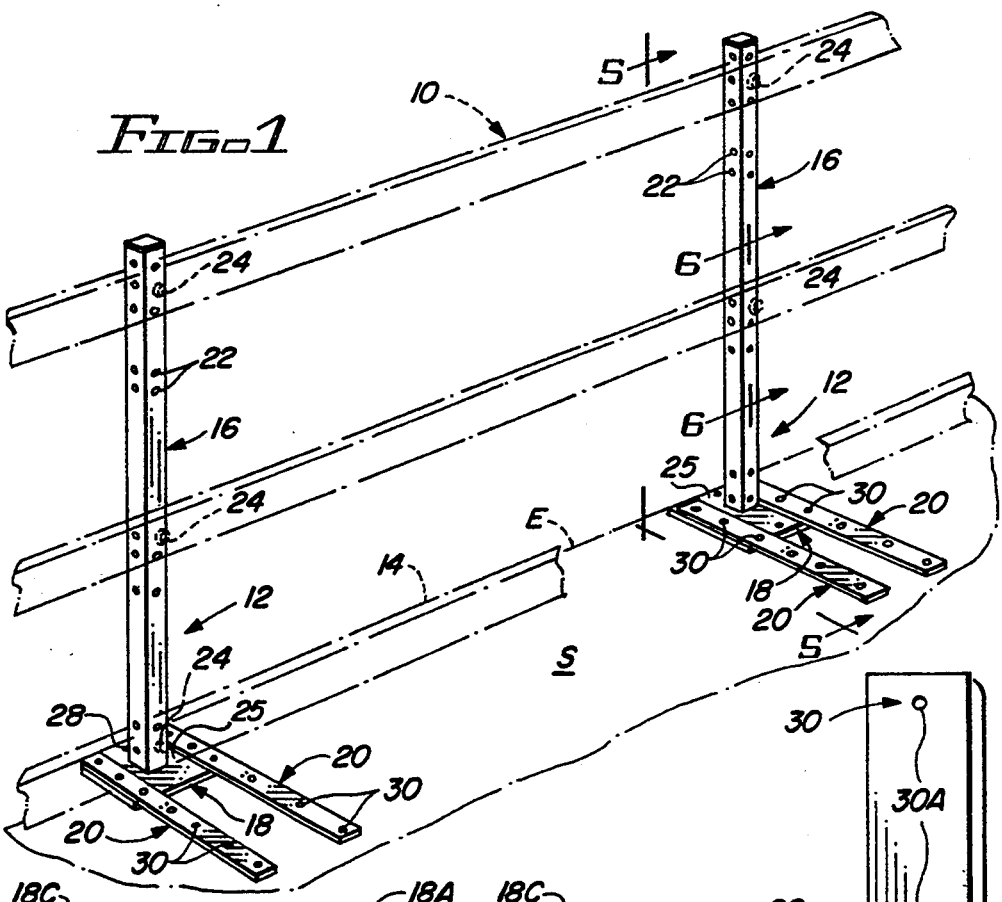
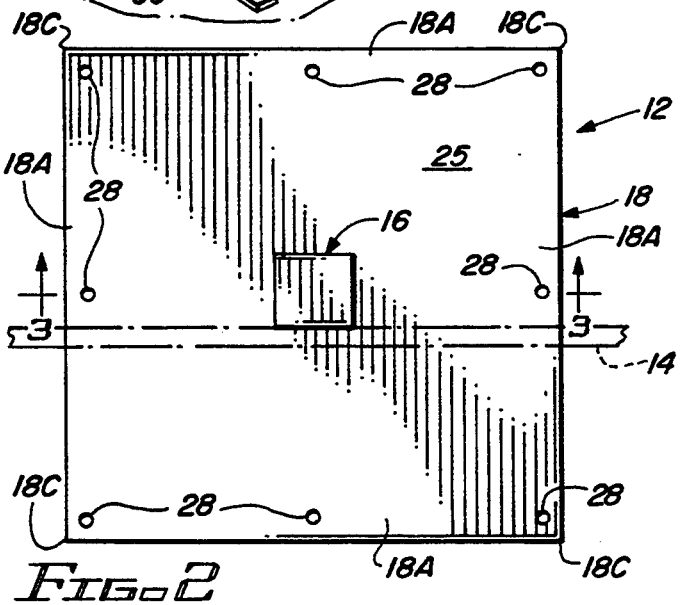
FIG. 2
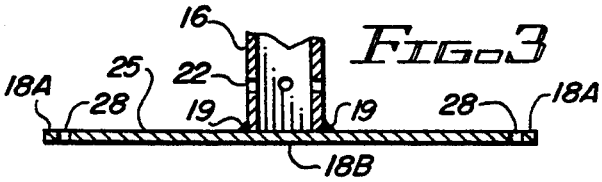
FIG. 3
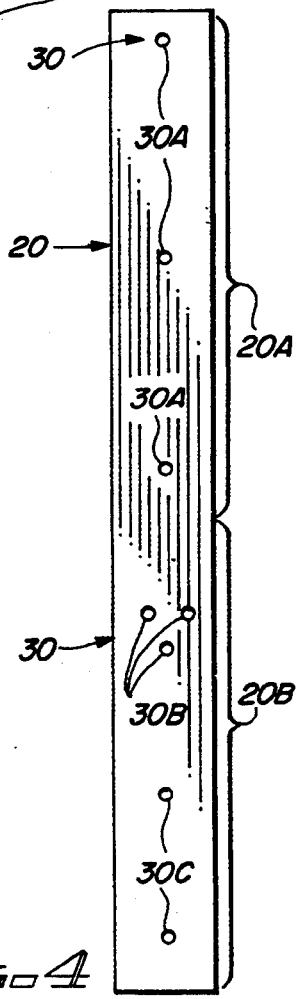
FIG. 4

E
28
26
16
25
20
18
18A
S
C
14
22
24
20A
20B

SAFETY POST ASSEMBLY

BACKGROUND OF THE INVENTION

1. Field of the Invention

The present invention generally relates to safety equipment for use at construction sites and, more particularly, is concerned with a safety post assembly.

2. Description of the Prior Art

The construction of most commerical building and residential homes typically involves considerable risk to craftsmen and others moving around the building site during the early stages of construction. Until framing of the structure is finished there is really no way to protect these persons as they work near edges of floors and staircases.

Regulations of the Occupational, Safety and Health Administration (OSHA) of the U.S. Government require the introduction of safety structures along locations which entail risk of fall for persons on the site. To satisfy OSHA regulations, these structures must exceed certain minimum lateral load requirements without experiencing permanent deformation or component failure. One safety rail system which has been tried in the past employed a safety post construction which included a rigid tubular metal post fixedly mounted upright on a flat rectangular plate which is screwed to the flooring. However, this safety post construction failed to withstand the minimum lateral load during testing and thus is unacceptable under current OSHA regulations.

Consequently, a need still exists for improvements in the design of safety rail systems so as to meet OSHA regulations.

SUMMARY OF THE INVENTION

The present invention provides a safety post assembly designed to satisfy the aforementioned need. The safety post assembly of the present invention meets OSHA requirements and so is adapted for use in constructing temporary rail systems installed when framing of a building is finished and removed as the installation of walls and permanent railing nears completion.

Accordingly, the present invention is directed to a safety post assembly which comprises: (a) a flat mounting plate adapted to rest on a support surface; (b) an upright post fixed in an upstanding relationship on a central portion of the mounting plate; (c) a pair of elongated narrow flat anchoring straps extendable over edge portions of the mounting plate and outwardly from the plate so as to overlie portions of the support surface upon which the safety post assembly is mounted; and (d) means for attaching the mounting plate and anchoring straps upon the support surface.

More particularly, the upright post has a plurality of apertures defined therein at vertically spaced locations along the post. The pair of elongated narrow flat anchoring straps have inner portions positionable over a pair of peripheral edge portions of the mounting plate and have outer portions extending outwardly from the inner portions and the mounting plate so as to overlie portions of the support surface located adjacent to the mounting plate. The attaching means is a plurality of fasteners adapted to attach the mounting plate and anchoring straps upon the support surface.

The mounting plate has a plurality of holes defined therein along peripheral edge portions of the plate and in spaced relationship to one another. The anchoring straps also have pluralities of openings defined therein, some being in a spaced relationship to one another which matches the spaced relationship between the holes in the mounting plate. The fasteners are adapted to extend through openings in the anchoring straps and through holes in the mounting plate that are aligned with the openings in the anchoring straps and then are screwed into the support surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a safety rail system employing a pair of safety post assemblies of the present invention.

FIG. 2 is a top plan view of an upright post and mounting plate of the safety post assembly.

FIG. 3 is a fragmentary sectional view of the upright post and mounting plate taken along line 3—3 of FIG. 2.

FIG. 4 is an enlarged plan view of an anchoring strap of the safety post assembly of FIG. 1.

DETAILED DESCRIPTION OF THE INVENTION

Figures 5, 6, 7, 8:
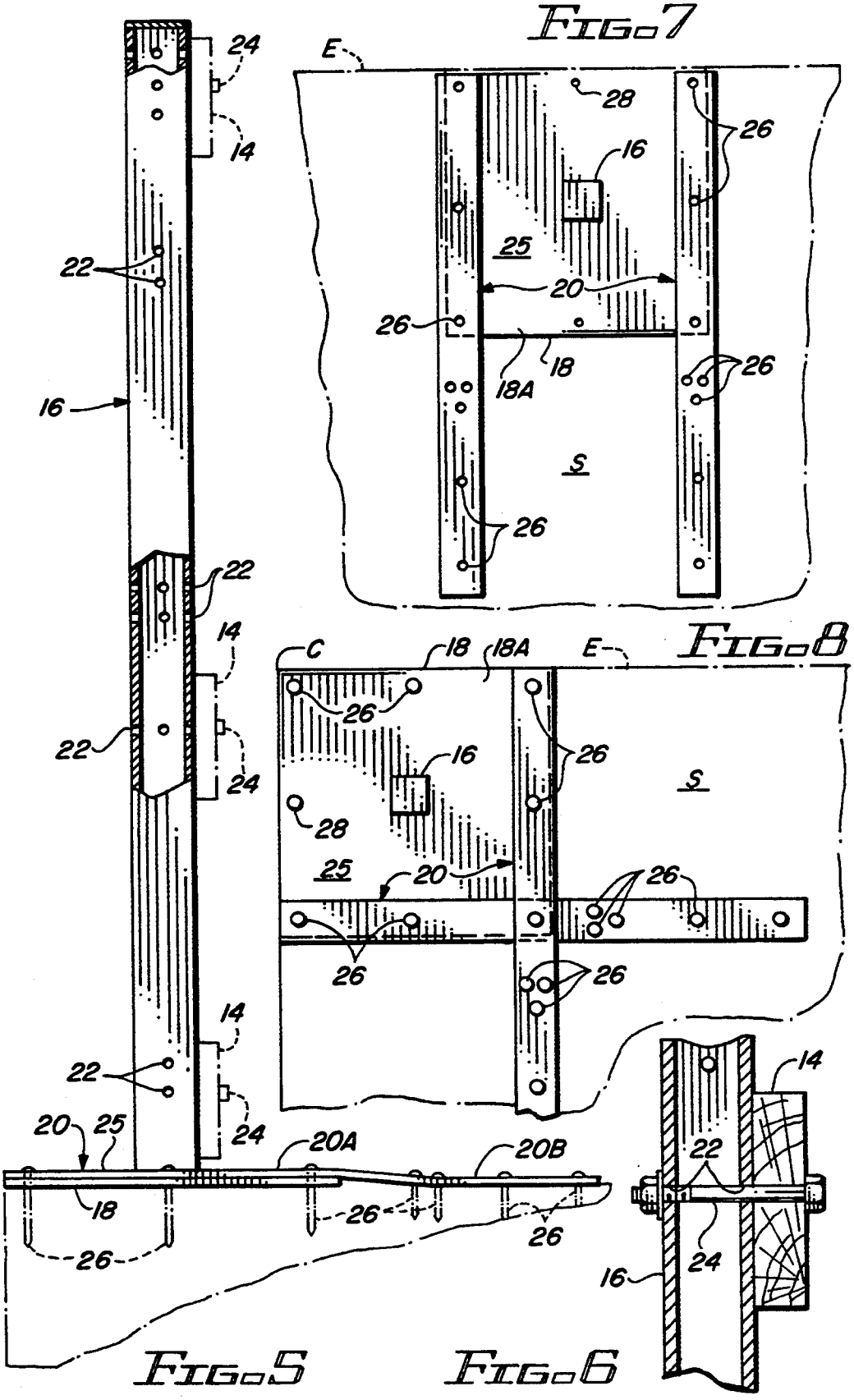
FIG. 5 is an enlarged side elevational view of the safety post assembly as seen along line 5—5 of FIG. 1.
FIG. 6 is an enlarged fragmentary sectional view of the upright post taken along line 6—6 of FIG. 1.
FIG. 7 is a top plan view of the embodiment of the safety post assembly of FIG. 5.
FIG. 8 is a view similar to that of FIG. 7 but of an alternate embodiment of the safety post assembly.

Referring to the drawings and particularly to FIG. 1, there is illustrated a safety rail system, generally designated 10, employing a pair of the safety post assemblies 12 of the present invention. The pair of safety post assemblies 12 are positioned along an edge E of a support surface S where they support a plurality of elongated rails 14 in vertically spaced relationship to provide protection against personnel falling from the edge E of the support surface S.

Referring to FIGS. 1–5, each safety post assembly 12 basically includes an upright post 16, a mounting plate 18 and a pair of elongated anchoring straps 20. The mounting plate 18 preferably is a rigid metal plate of square shape and flat configuration adapting it to rest flush on the support surface S. The flat mounting plate 18 has a plurality of peripheral edge portions 18A.

The post 16 preferably is a rigid metal post having a square configuration in cross-section. The post 16 is fixed in an upstanding relationship on a central portion 18B of the mounting plate 18. The post 16 is so fixed upon the mounting plate 18 in any suitable manner, such as by welds 19 shown in FIG. 3. As best seen in FIG. 5, the upright post 16 has a plurality of apertures 22 defined therein at vertically spaced locations along the post 16. The elongated rails 14 are supported on the post 16 in vertically spaced relationship by fasteners 24, such as bolts, extending through the rails 14 and selected ones of the apertures 22, as best shown in FIGS. 5 and 6.

Each of the elongated anchoring straps 20 is substantially longer (for example, approximately two times longer) than each of the peripheral edge portions 18A of the mounting plate 18. Thus, each anchoring strap 20 has an inner portion 20A positionable along and over one of the peripheral edge portions 18A of the mounting plate 18 and an outer portion 20B extendable outwardly from the inner portion 20A and beyond the mounting plate 18. As seen in FIGS. 1 and 5, the inner portion 20A of each anchoring strap 20 is disposed in a flush contacting relationship with and upon the top surface 25 of the flat mounting plate 18 along the respective one peripheral edge portion 18A thereof. Thus, the outer portion 20B of the anchoring strap 20 overlies a portion of the support surface S located adjacent to the mounting plate 18. Each anchoring strap 20 is made of a suitable material, preferably a metal material, and is sufficiently flexible to allow it to be bent downwardly from the level of the mounting plate 18 to the support surface S, as seen in FIG. 5.

Each safety post assembly 12 also includes means in the form of a plurality of fasteners 26, such as screws, for attaching the mounting plate 18 and anchoring straps 20 upon the support surface S. For attaching the mounting plate 18 and anchoring straps 20 upon the support surface S by using the screws 26, the mounting plate 18 has a plurality of holes 28 defined therein along peripheral edge portions 18A of the plate 18 and in spaced relationship to one another. Preferably, as seen in FIG. 2, the holes 28 are defined in each of the corners 18C of the mounting plate 18 and along the edge portions 18A at the midpoint between the corners 18C. Also, as seen in FIG. 4, each of the anchoring straps 20 has pluralities of openings 30 defined therein in spaced relationship to one another. The spacing between a first group of the openings 30A along the inner portion 20A of each strap 20 matches that of the holes 28 in the mounting plate 18. As seen in FIG. 5, the screws 26 can be extended through the first group of openings 30A in the inner portions 20A of the anchoring straps 20 and through the holes 28 in the respective peripheral edge portion 18A of the mounting plate 18 which are aligned with the openings 30A in the anchoring straps 20. The screws 26 are then threaded into the support surface S. A second group of the openings 30B are provided in each anchoring strap 20 in a closely spaced triangular configuration at the location where the outer portion 20B of the anchoring strap 20 is bent downwardly from the inner portion 20A of the strap 20 at the higher level of the mounting plate 18 to the lower level of the support surface S. The concentration of a second group of openings 30B at such location prevents loosening of the screws 26 and thus of the strap 20. A third group of the openings 30C are provided in the outer portion 20B of the strap 20. As can be observed in FIG. 4, the openings 30C in the outer portion 20B are spaced closer to one another than are the openings 30A in the inner portion 20A of the strap 20.

Referring to FIGS. 1 and 7, the mounting plate is shown positioned along the edge E of the support surface S. The anchoring straps 20 are positioned over a pair of the spaced opposite parallel peripheral edge portions 18A of the mounting plate 18 such that the anchoring straps 20 extend in a substantially parallel relation to one another and in a perpendicular relation to the edge E of the support surface S.

Referring to FIG. 8, the mounting plate 18 is shown positioned at a corner C of the support surface S. The anchoring straps 20 are positioned over a pair of peripheral edge portions 18A of the mounting plate 18 extending at a substantially right angle to one another such that the anchoring straps 20 extend in a substantially perpendicular criss-cross relationship to one another and in perpendicular relationships to the respective edges E of the support surface S forming the corner C.

It is thought that the present invention and its advantages will be understood from the foregoing description and it will be apparent that various changes may be made thereto without departing from the spirit and scope of the invention or sacrificing all of its material advantages, the form hereinbefore described being merely preferred or being an exemplary embodiment thereof.

I claim:

1. A safety post assembly, comprising:

(a) a flat mounting plate adapted to rest on a support surface, said flat mounting plate having a top surface and a plurality of edge portions;

(b) an upright post fixed in an upstanding relationship on a central portion of said mounting plate;

(c) a pair of elongated substantially narrow anchoring straps each extendable over a different one of a pair of said edge portions of said mounting plate in a flush contacting relationship with said top surface of said flat mounting plate and outwardly from said mounting plate so as to overlie portions of the support surface upon which said safety post assembly is mounted; and (d) means for attaching said straps in said flush contacting relationship upon said top surface of said mounting plate and for attaching said mounting plate and straps upon the support surface.

2. The assembly of claim 1 wherein said upright post has a plurality of apertures defined therein at vertically spaced locations along said upright post for attachment of rails thereto.

3. The assembly of claim 1 wherein each of said anchoring straps has an inner portion positionable over said different one of said pair of edge portions of said mounting plate and has an outer portion extending outwardly from said inner portion and said mounting plate so as to overlie a of the support surface located adjacent to said mounting plate.

4. The assembly of claim 1 wherein said attaching means is a plurality of fasteners adapted to attach said mounting plate and said anchoring straps upon the support surface.

5. The assembly of claim 1 wherein:

said pair of edge portions of said mounting plate are disposed in spaced opposite parallel relationship to one another; and said anchoring straps are positionable over said different ones of said pair of said edge portions of said mounting plate such that said anchoring straps extend in a substantially parallel relation to one another and in a perpendicular relation to an edge of the support surface when said mounting plate is positioned along the edge of the support surface.

6. A safety post assembly, comprising:

(a) a flat mounting plate adapted to rest on a support surface, said flat mounting plate having a top surface and a plurality of edge portions;

(b) an upright post fixed in an upstanding relationship on a central portion of said mounting plate;

(c) a pair of elongated substantially narrow anchoring straps each extendable over a different one of a pair of said edge portions of said mounting plate and outwardly from said mounting plate so as to overlie a portion of the support surface upon which said safety post assembly is mounted; and (d) means for attaching said mounting plate and anchoring straps upon the support surface;

(e) said mounting plate having a plurality of holes defined therein along said edge portions of said mounting plate and in spaced relationship to one another;

(f) said anchoring straps having pluralities of openings defined therein, some of said openings being in a spaced relationship to one another which matches said spaced relationship between said holes in said mounting plate.

7. The assembly of claim 6 wherein said attaching means is a plurality of fasteners adapted to attach said mounting plate and said anchoring straps upon the support surface, said fasteners being extendable through said openings in said anchoring straps and through said holes in said mounting plate being aligned with said openings in said anchoring straps and then fastenable into the support surface.

8. A safety post assembly, comprising:

(a) a flat mounting plate adapted to rest on a support surface, said flat mounting plate having a top surface and a plurality of edge portions;

(b) an upright post fixed in an upstanding relationship on a central portion of said mounting plate;

(c) a pair of elongated substantially narrow anchoring straps each extendable over a different one of a pair of said edge portions of said mounting plate and outwardly from said mounting plate so as to overlie a portion of the support surface upon which said safety post assembly is mounted; and (d) means for attaching said mounting plate and anchoring straps upon the support surface;

(e) said anchoring straps being positionable over said respective one of a pair of edge portions of said mounting plate extending at a substantially right angle to one another such that said anchoring straps extend in a substantially perpendicular crisscross relationship to one another and in perpendicular relationships to respective edges of the support surface forming a corner thereof when said mounting plate is positioned at the corner of the support surface.

9. A safety post assembly, comprising:

(a) a flat mounting plate adapted to rest on a support surface and having a top surface and a plurality of peripheral edge portions;

(b) an upright post fixed in an upstanding relationship on a central portion of said mounting plate;

(c) a pair of elongated substantially narrow anchoring straps each extendable over a different one of a pair of said peripheral edge portions of said mounting plate in a flush contacting relationship with said top surface of said flat mounting plate and outwardly from said mounting plate so as to overlie portions of the support surface upon which said safety post assembly is mounted, each of said anchoring straps having an inner portion positionable over one of said peripheral edge portions of said mounting plate in said flush contacting relationship with said top surface thereof, each of said anchoring straps also having an outer portion extending outwardly from said inner portion and said mounting plate so as to overlie a portion of the support surface located adjacent to said mounting plate, said pair of peripheral edge portions of said mounting plate over which said anchoring straps are positionable being disposed in opposite spaced parallel relation to each other such that said anchoring straps extend in a substantially parallel relation to one another and in a perpendicular relation to the edge of the support surface when said mounting plate is positioned along an edge of the support surface; and (d) means for attaching said anchoring straps in said flush contacting relationship upon said top surface of said mounting plate and for attaching said mounting plate and anchoring straps upon the support surface.

10. The assembly of claim 9 wherein said attaching means is a plurality of fasteners adapted to attach said mounting plate and said anchoring straps upon the support surface.

11. A safety post assembly, comprising:

(a) a flat mounting plate adapted to rest on a support surface and having a plurality of peripheral edge portions;

(b) an upright post fixed in an upstanding relationship on a central portion of said mounting plate;

(c) a pair of elongated substantially narrow anchoring straps extendable over a different one of a pair of said peripheral edge portions of said mounting plate and outwardly from said mounting plate so as to overlie portions of the support surface upon which said safety post assembly is mounted, each of said anchoring straps having an inner portion positionable over one of said peripheral edge portions of said mounting plate, each of said anchoring straps also having an outer portion extending outwardly from said inner portion and said mounting plate so as to overlie a portion of the support surface located adjacent to said mounting plate, said pair of peripheral edge portions of said mounting plate over which said anchoring straps are positionable being disposed in opposite spaced parallel relation to each other such that said anchoring straps extend in a substantially parallel relation to one another and in a perpendicular relation to the edge of the support surface when said mounting plate is positioned along an edge of the support surface; and (d) means for attaching said mounting plate and anchoring straps upon the support surface;

(e) said mounting plate having a plurality of holes defined therein along said peripheral edge portions of said mounting plate and in spaced relationship to one another;

(f) said anchoring straps having pluralities of openings defined therein, some of said openings being in a spaced relationship to one another which matches said spaced relationship between said holes in said mounting plate.

12. The assembly of claim 11 wherein said attaching means is a plurality of fasteners adapted to attach said mounting plate and said anchoring straps upon the support surface, said fasteners being extendable through said openings in said anchoring straps and through said holes in said mounting plate being aligned with said openings in said anchoring straps and then fastenable into the support surface.

13. A safety post assembly, comprising:

(a) a flat mounting plate adapted to rest on a support surface, said flat mounting plate having a plurality of peripheral edge portions;

(b) an upright post fixed in an upstanding relationship on a central portion of said mounting plate;

(c) a pair of elongated substantially narrow anchoring straps extendable over a pair of said peripheral edge portions of said mounting plate and outwardly from said mounting plate so as to overlie portions of the support surface upon which said safety post assembly is mounted, each of said anchoring straps having an inner portion positionable over one of said pair of peripheral edge portions of said mounting plate, each of said anchoring straps also having an outer portion extending outwardly from said inner portion and said mounting plate so as to overlie a portion of the support surface located adjacent to said mounting plate, said pair of said peripheral edge portions of said mounting plate over which said anchoring straps are positionable extending at a substantially right angle relation to one another such that said anchoring straps extend in a substantially perpendicular crisscross relationship to one another and in perpendicular relationships to respective edges of the support surface forming a corner thereof when said mounting plate is positioned at the corner of the support surface; and (d) means for attaching said mounting plate and anchoring straps upon the support surface.

14. The assembly of claim 13 wherein said attaching means is a plurality of fasteners adapted to attach said mounting plate and said anchoring straps upon the support surface.

15. The assembly of claim 14 wherein said mounting plate has a plurality of holes defined therein along said peripheral edge portions of said mounting plate and in spaced relationship to one another.

16. The assembly of claim 15 wherein said anchoring straps have pluralities of openings defined therein, some of said openings being in a spaced relationship to one another which matches said spaced relationship between said holes in said mounting plate.

17. The assembly of claim 16 wherein said fasteners are extendable through said openings in said anchoring straps and through said holes in said mounting plate being aligned with said openings in said anchoring straps and then fastenable into the support surface.

18. The assembly of claim 13 wherein said upright post has a plurality of apertures defined therein at vertically spaced locations along said upright post.

* * * * *